US005673658A

United States Patent [19]

Allmendinger

[11] Patent Number: 5,673,658

[45] Date of Patent: Oct. 7, 1997

[54] HYDRAULIC-MECHANICAL VALVE OPERATING MECHANISM

[75] Inventor: Richard Allmendinger, Stuttgart, Germany

[73] Assignee: Daimler-Benz AG, Stuttgart, Germany

[21] Appl. No.: 747,253

[22] Filed: Nov. 18, 1996

[30] Foreign Application Priority Data

Nov. 29, 1995 [DE] Germany ..... 195 44 473.6

[51] Int. Cl.[6] ..... F01L 9/02

[52] U.S. Cl. ..... 123/90.12; 123/90.15

[58] Field of Search ..... 123/90.11, 90.12, 123/90.13, 90.14, 90.15, 90.16

[56] References Cited

U.S. PATENT DOCUMENTS

| | | | |
|---|---|---|---|
| 5,058,538 | 10/1991 | Erickson et al. | 123/90.12 |
| 5,193,495 | 3/1993 | Wood, III | 123/90.15 |
| 5,259,345 | 11/1993 | Richeson | 123/90.12 |
| 5,345,904 | 9/1994 | Dopson et al. | 123/90.16 |
| 5,555,861 | 9/1996 | Mayr et al. | 123/90.16 |
| 5,558,052 | 9/1996 | Schwarzenthal et al. | 123/90.16 |

FOREIGN PATENT DOCUMENTS

| | | |
|---|---|---|
| 37 39 775 | 6/1988 | Germany . |
| 30 24 109 | 9/1989 | Germany . |
| 38 36 725 | 12/1989 | Germany . |
| 39 11 495 | 8/1990 | Germany . |

*Primary Examiner*—Weilun Lo
*Attorney, Agent, or Firm*—Klaus J. Bach

[57] ABSTRACT

In a hydraulic-mechanical operating mechanism for a breathing valve of an internal combustion engine in which the valve is engaged by two compression springs, one biasing the valve in opening direction and the other biasing the valve in a closing direction, the valve has a stem with first and second cam areas for engagement by the pistons of first and second cylinder and piston structures for retaining the valve in its closed and open end positions wherein the first cylinder and piston structure includes spring means biasing its piston into engagement with the associated cam area and the second cylinder and piston structures includes spring means biasing the associated piston away from the associated cam area and the respective cylinders can be hydraulically actuated to release the valve when it is in the closed end position and to engage the valve when it is in its open end position.

8 Claims, 2 Drawing Sheets

Fig. 3
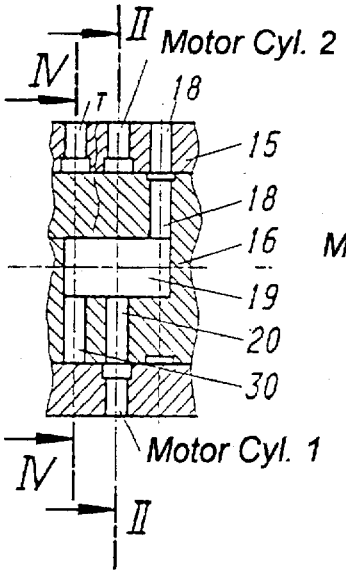
Fig. 2
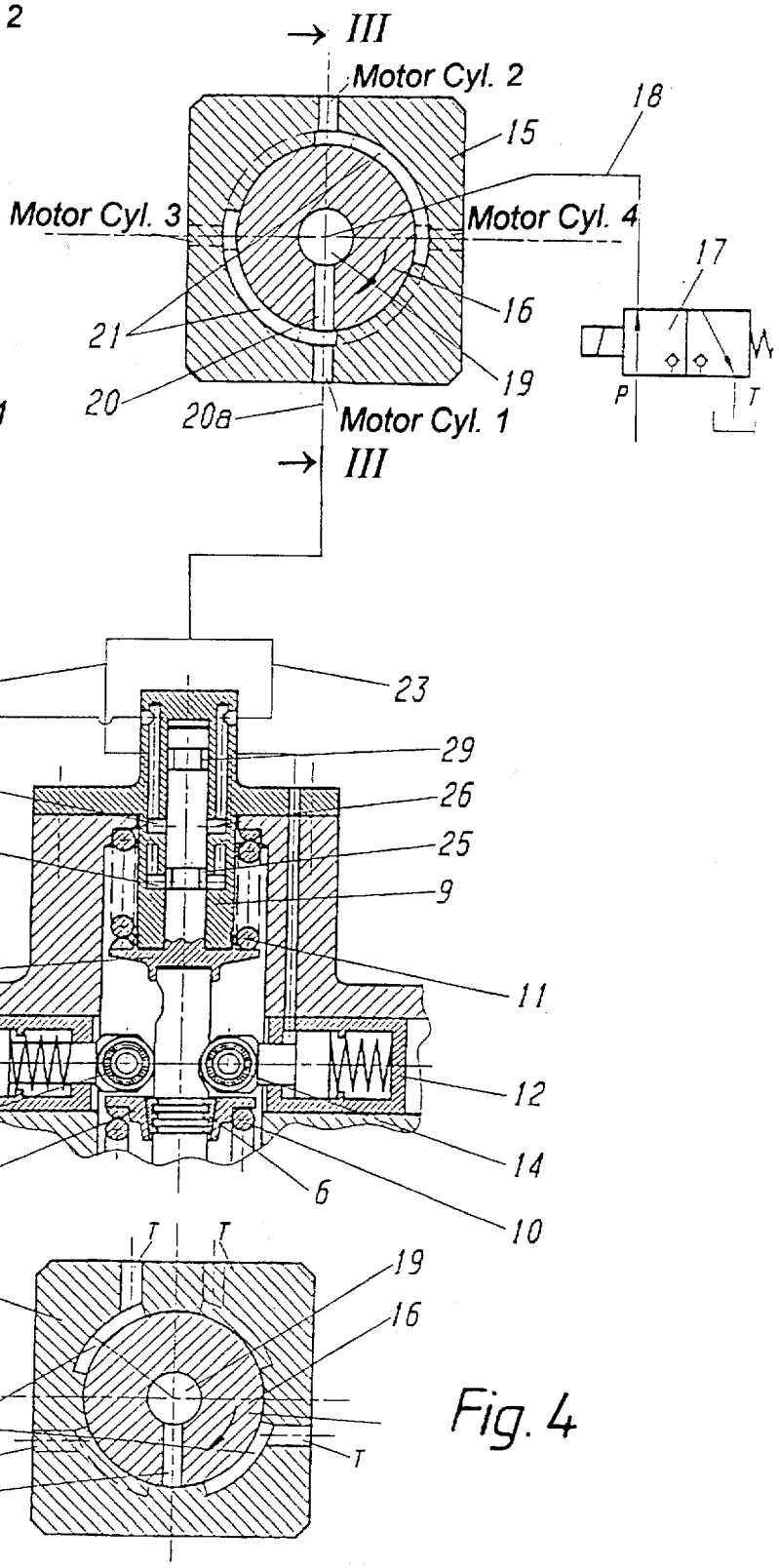
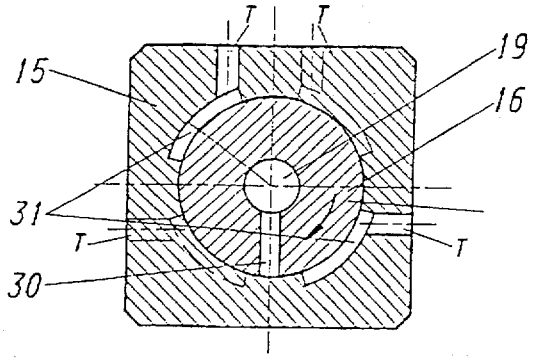
Fig. 4

HYDRAULIC-MECHANICAL VALVE OPERATING MECHANISM

BACKGROUND OF THE INVENTION

The invention relates to a hydraulic-mechanical valve operating mechanism for controlling the breathing valves of internal combustion engines wherein each valve operating mechanism includes two springs, one actuating the valve in opening direction and the other actuating the valve in closing direction.

Such a valve operating mechanism is disclosed for example in DE 38 36 725 C1. The breathing valves, that is the intake and exhaust valves of an internal combustion engine are generally actuated by cam shafts. Camshafts however do not provide for variable valve opening and closing times. Freely controllable valve operating mechanisms on the other hand have generally high energy consumption or other principle-based disadvantages. Systems utilizing a spring mass oscillator principle however have lower energy requirements. Of this type, mainly electromagnetic (DE 30 24 109 A1), but also hydraulic valve operating mechanisms as described for example in DE 38 36 725 C1 are known.

DE 37 39 775 A1 discloses an arrangement for operating the breathing valves of an internal combustion piston engine which includes a control piston and locking means for fixing the control piston in its end positions. The locking means can be controlled to release the piston depending on the operating condition of the engine.

However, the arrangement described in this publication is very rigid and is not capable of accommodating, or adapt to, varying lengths in the area of the valve.

Another engine breathing valve is described in German patent No. 1 258 184, wherein the spring-mass principle is utilized. The valve includes a valve shaft with an annular groove receiving the retaining means for the spring support washer and, between the annular groove and the top of the valve, a shaft section of a reduced diameter and an axial length which is greater than the axial length of the annular grove. The transition from the smaller diameter shaft section is rounded to form a neck area with a radius which is substantially larger than half the difference between the normal and reduced shaft diameters.

The purpose of this arrangement is merely to reduce the chance of fracture of the valve shaft because of the groove receiving the mounting elements for the valve support washer. The valve does not include a hydraulic mechanical control; particularly no variable stroke control for such a valve is disclosed in this publication.

DE 39 11 495 further discloses a hydraulic mechanical valve operating unit for piston engines wherein the opening as well as the closing movements of the valve are hydraulically controlled, the valve being biased by springs in both directions of movement.

With electromagnetically operated oscillators, the rest position of the valve is at half valve travel length so that the oscillating movement in opening direction requires large magnets. Another disadvantage based thereon is the requirement for deep valve pockets in the pistons which affect the combustion process but which are needed since malfunctioning of the valve operating mechanism is always possible.

Because of the relatively high energy requirements for opening the exhaust valve against the exhaust gas pressure in the cylinder, only inlet valves have been operated by an electromagnetic operating mechanism. In any case, the space available around the valves is very limited. Also means must be provided to limit the high speed of the valves at their end positions. These high speeds are the natural result of the force-travel characteristic curve of the magnets. Also, a practically usable solution to accommodate the lengths changes of the components used in a valve operating mechanism has not really been found yet, that is, the solutions proposed so far are very expensive, disadvantageous or impractical.

It is the object of the present invention to provide a valve operating mechanism of the type referred to above which however does not require any valve play adjustments. Furthermore, a hydraulic coupling should be provided whereby the valve always returns to a rest position in which the valve is closed.

SUMMARY OF THE INVENTION

In a hydraulic-mechanical operating mechanism for a breathing valve of an internal combustion engine in which the valve is engaged by two compression springs, one biasing the valve in opening direction and the other biasing the valve in closing direction, the valve has a stem with first and second cam areas for engagement by the pistons of first and second cylinder and piston structures for retaining the valve in its closed and open end positions wherein the first cylinder and piston structure includes spring means biasing its piston in engagement with the associated cam area and the second cylinder and piston structures includes spring means biasing the associated piston away from the associated cam area and the respective cylinders can be hydraulically actuated to release the valve when it is in the closed end position and to engage the valve when it is in its open end position.

With this arrangement, the breathing valves are held in place in their closed positions so that it is not necessary to provide the deep pockets in the piston for receiving the valves in case of malfunction. Furthermore, all the valve catch and retaining steps are self-activated.

It is a further advantage of the arrangement according to the invention that length variations of the valves as they may occur by heat expansion or wear can be accommodated by the mechanism.

In addition, the mechanism requires relatively little installation space, particularly in axial direction of the valve and it can be employed for various load control procedures. For example, opening phase and opening duration of the breathing valves can be changed or set in any desired way. It is also possible to shut down certain valves and cylinders and to freely select the valve opening and closing times and sequences.

Various embodiments of the invention will be described below on the basis of the accompanying drawings.

BRIEF DESCRIPTION OF THE DRAWINGS

FIG. 2 shows a hydraulic control arrangement with control piston, control valves and control shaft of the valve operating mechanism according to the invention and, in a partial sectional view, the control shaft with housing taken along line II—II of FIG. 3, FIG. 3 is a cross-sectional view of the control shaft taken along line III—III of FIG. 2, and FIG. 4 is a cross-sectional view of the control shaft taken along line IV—IV of FIG. 3.

DESCRIPTION OF THE PREFERRED EMBODIMENT

Figure 1:
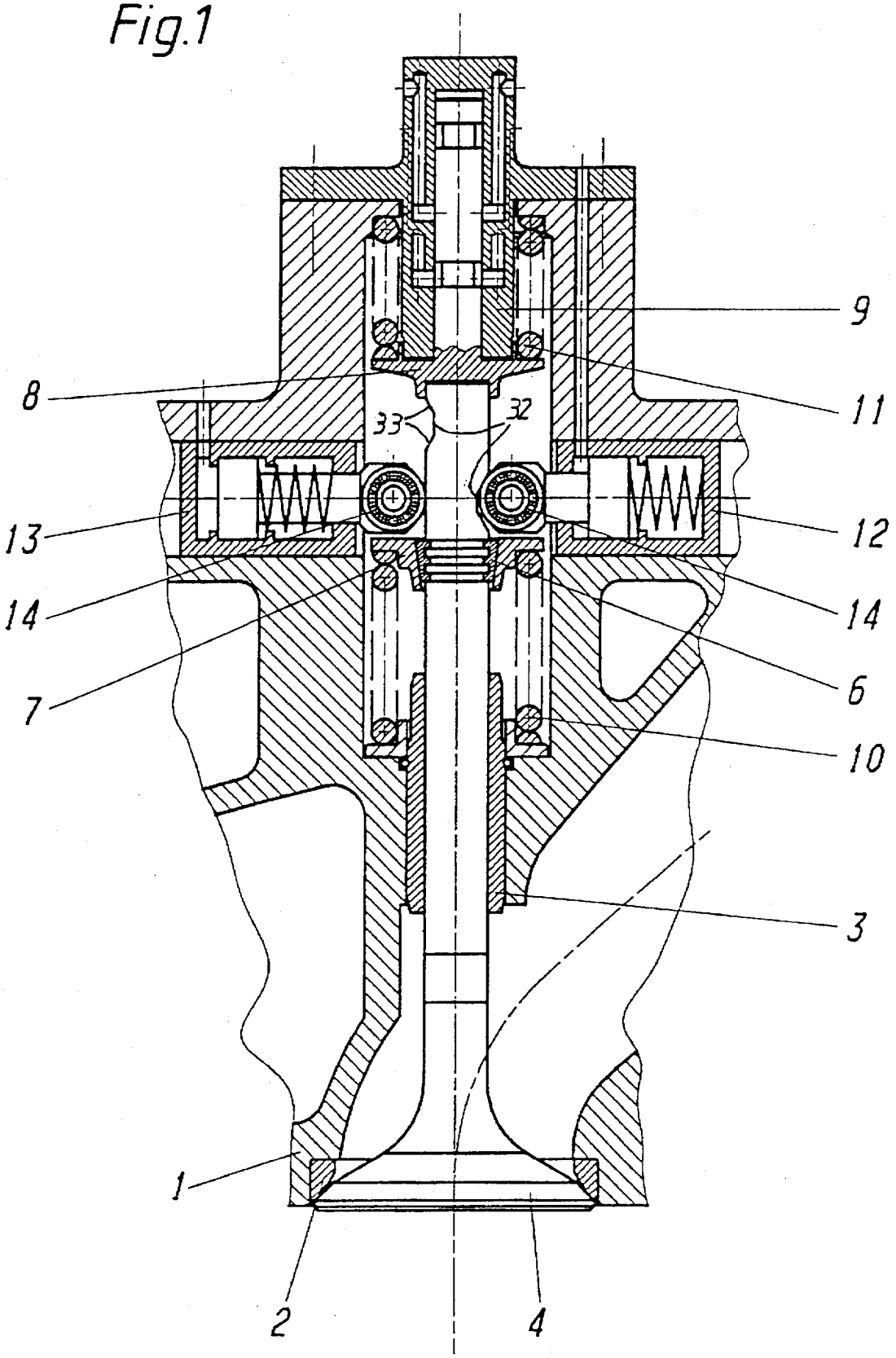
FIG. 1 is an enlarged cross-sectional view of a valve operating mechanism according to the invention.

FIG. 1 shows a valve operating arrangement which, to a large extent, comprises conventional components as described in the prior art. Consequently, only the parts of the valve which are important with regard to the present invention are described in greater detail.

The operating mechanism is disposed in a cylinder head 1 with a valve seat 2 and a valve guide 3. A breathing valve 4 is shown in a closed position. It includes a spring support washer 7 which is mounted to the valve shaft by conical mounting pieces 6 and cam areas 32 with ramps 33 which are formed into the upper part of the valve shaft. An upper valve spring support washer and control piston structure 8 is disposed on top of the breathing valve 4 and is guided in a control piston housing 9 in which the necessary control and connecting passages are disposed. Compression springs 10 and 11 are provided which engage the spring support washer 7 and 8, respectively. The compression spring 10 which is also called the valve spring applies to the breathing valve 4 a force in the closing direction whereas the compression spring 11 is so arranged that it applies to the breathing valve 4 a force in its opening direction.

On a surface of the cylinderhead 1, which extends normal to the axis of the breathing valve 4 opposite cylinders 12 and 13 are mounted. The cylinder 12 is provided for retaining the valve in a closed position and the cylinder 13 is provided for retaining the valve in an open position.

FIG. 2 shows a control shaft 16 disposed in a housing 15 which is shown hydraulically connected to the upper part of the arrangement shown in FIG. 1 for controlling the valve operation. The control shaft 16 is operated by the crankshaft of the engine so that it rotates for example at ½ of crankshaft speed. The control shaft 16 includes an oil chamber 19 and a radial bore 20 whose angular position corresponds to a position of the engine piston for example that of the No. 1 cylinder. At the circumference of the control shaft 16, the housing 15 has grooves 21 extending over a certain angle such that a bore 20*a* places the groove into communication with a respective engine cylinder, that is, its breathing valve 4. Furthermore, there is an electromagnetically operated control valve 17 which, by way of a hydraulic fluid supply line 18, provides for communication with a pressurized fluid supply (not shown) or a hydraulic fluid tank T.

In another cross-sectional plane as shown in FIG. 4, other groove segments 31 are shown arranged in other angular positions. Bores communicating with these groove segments 31 provide for communication with the tank T of a hydraulic system which may be present in a motor vehicle in any case.

The operation of the arrangement according to the invention will be described below on the basis of an operating cycle.

In the rest position of the spring mass system which is formed by the compression springs 10, 11, the spring support washers 7 and 8, the spring support washer mounting cone pieces 6 and the breathing valve 4, the breathing valve 4 is closed and the electromagnetically operated valve 17 is de-energized, that is, the admission of fluid from the pressurized fluid source is blocked and the communication line 18 is connected to the tank T and, consequently, not under pressure. A compression spring in the cylinder 12 engages a piston which is movably disposed in the cylinder 12 and forces a roller bearing 14 mounted on a rod extending of the piston onto one of the ramps 33 of the breathing valve 4 such that a force in closing direction of the valve is generated whereby the valve 4 is kept closed against the force of the spring 11. Changes in length between the cylinderhead 1 around the valve 4 and the valve 4 itself are accommodated in that the roller bearing mounted on the piston rod projecting from the cylinder 12 moves inwardly on the ramp 33 of the cam area 32 until the valve 4 is seated on the valve seat ring 2.

Furthermore, a compression spring in the cylinder 13 biases a piston disposed therein toward its inner stop while the roller bearing mounted on the piston rod of the piston associated with the cylinder 13 engages the shaft of the breathing valve 4.

The breathing valve 4 which is for example in the cylinderhead 1 of the engine can only be opened when the bore 20 in the control shaft 16 is in communication with the groove section 21 so that pressurized oil can be supplied through the bore 20*a* to the valve operating mechanisms of cylinder 1 for example. If, in this period, the control valve 17 is opened at any point, opening of the valve 4 is initiated.

To achieve this, the control valve 17 is energized such that pressurized fluid provided by the pressurized fluid source can pass through the control valve 17 and the communication line 18 to the oil chamber 19 and then through the bore 20, the groove segment 21 and the bore 20*a* and the lines 22 and 23 and finally through the annular passages 23 and 25 and bore 26, to the pressure chamber of the cylinder 12. The connection between the annular passages 24 and 25 and the bore 26 is shown only by dashed lines. The same is true for the flow connection between the line 22 and the annular channels 22 and 25. The piston of the cylinder 12 is moved thereby to its inner stop (in the drawing to the right) and the roller bearing 14 releases the ramp 33 on the shaft of 30 the valve 4 so that the valve moves in opening direction under the force of spring 11 which is higher than that of the spring 10. The line 23 is blocked at this point. It is only opened when the control edges of valve 4, that is, the control piston structure 8 and the control piston housing cooperate—depending on the position of the breathing valve 4.

When the upper control edge of the annular channel 25 reaches the lower control edge of the annular channel 24, communication between the line 22 and the bore 26 is interrupted whereby the pressure space in the cylinder 12 is closed up and the piston of the cylinder 12 is held in its position in engagement with its inner stop. After further travel of the control piston, the lower control edge of an annular space 29 opens a passage to an annular space 29 and, consequently, a connection between the oil chamber 19 and the pressure space of cylinder 13 via lines 20*a*, 23 and 27. By way of the control valve 17 which is still energized, the piston of the cylinder 13 is subjected to pressurized oil whereby the roller bearing 14 is pressed onto the shaft of the valve 4. When the valve 4 reaches its open end position the roller bearing moves into the recess between the ramps 33 on the shaft of the valve 4 such that, on one hand, the valve is firmly held in its open end position and, on the other hand, the piston engages the outer stop of the cylinder 13.

To initiate the closing movement of the valve 4, the control valve 17 is de-energized which provides for a flow connection from the pressure space of the cylinder 13 to the tank T by way of the line 27, the annular spaces 28 and 29, the lines 23 and 20*a*, the groove 21, the bore 20, the oil chamber 19 and the connecting line 18. As a result, the compression spring in the cylinder 13 can move the piston to its inner stop (in the drawing to the left) whereby, at the same time, the roller bearing 14 moves away from the ramp 33 so that the valve can move in closing direction.

When the lower control edge of the annular channel 25 reaches the upper control edge of the annular channel 24, the oil under pressure in the cylinder 12 is relieved by way of bore 26 and line 22 and so on, as known, into the tank T. As a result, the spring in the cylinder 12 can move the piston of cylinder 12 with the roller bearing 14 onto the respective ramp of the cam area 32 when the valve 4 reaches its closed position. At this point, the original position is re-established.

If the control shaft 16 has rotated and has passed the point up to which a valve 4 closing stroke can be initiated without the control valve 17 having provided a return passage for the oil to the tank T, for example, because of an error in the control arrangement, a passage way is provided to the tank T by way of the bore 30 at a particular angular position of the control shaft 16 (see FIG. 4). In this manner, draining to the tank T is provided by way of the line 20*a*, the control valve 17 being by-passed, so that the valve 4 can safely be closed in any case.

By providing the ramps 33 on the cam areas 32 which can be engaged by the roller bearings 14, length variations occurring for example by temperature expansion or by wear can be compensated for.

With the arrangement of the control valve 17 and the control shaft 16, the control valve 17 can attend to the control functions for more than one hydraulic cylinder or valve with the same function and non-overlapping angular control positions.

With the arrangement according to the invention wherein the upper control position structure with the spring support washer for the valve 4 is a control piston in the form of a spool valve, a hydraulic coupling of the system can be accomplished eliminating the need for additional control valves which would otherwise have to be provided t perform that task.

If the communication line 18 is always maintained under pressure, the hydraulic cylinders 12 which are provided for holding the valves in their closed positions would, with appropriately designed grooves 21 be subjected to pressure always at the same angular position of the crankshaft so that the respective valve 4 would always be opened at the same angular crankshaft position. With a corresponding procedure, also closing of the valve 4 would start always at the same angular crankshaft position, that is if the electronic control system or the control valve 17 fails, the engine can still be operated with pre-set valve opening and closing times. Then the arrangement would operate about like an engine with a normal cam shaft so that a vehicle could still be operated.

The pre-tension of the compression spring 11 which provides for the opening of the valve 4 can be adjustable. This can be achieved for example in that the spring support can be moved mechanically or hydraulically or by other means (for example, cyclically). In this way, a stroke change of the valve is possible as well as an adaptation to other engine requirements. If, for example, the valve pre-tension is increased, there is an excess force provided by which the higher opening force for opening the exhaust valve could be provided. If the pre-tension is reduced, the valve opening stroke becomes smaller since the neutral position of the valve is changed. Such an arrangement could be used if the valve is not to be held in its open position but would be returned to the closed position immediately after reaching its open end position.

The pressure needed for the operation of the hydraulic cylinders 12 and 13 can be generated by a piezo actor or a magnetostrictive or another actor (cylinder) which could also assume the function of the control valve 17. As operating fluid, oil from the engine or from another oil flow circuit could be used.

The cam area 32 can be cut into the valve stem or it may be provided by a separate guide structure for example a cam structure formed on a sleeve which is disposed on the shaft of the valve 4.

What is claimed is:

1. A hydraulic-mechanical operating mechanism for a breathing valve of an internal combustion engine, comprising two compression springs engaging said valve in opposing directions, one in valve opening and the other in valve closing direction, said valve being movable between open and closed end positions and being provided with first and second cam areas, a first hydraulic cylinder and a first piston structure arranged so as to engage said first cam area for retaining said valve in its closed position, said first hydraulic cylinder and piston structure including first spring means biasing said first piston into engagement with said first cam area, and a second hydraulic cylinder and a second piston structure including a second spring means biasing said second piston away from said second cam area, and means for supplying fluid under pressure to said first hydraulic cylinder and piston structure for releasing said valve from its closed position and to said second hydraulic cylinder and piston structure for engaging said valve in its open position.

2. A valve operating mechanism according to claim 1, wherein said pistons of said hydraulic cylinder and piston structures have piston rods extending toward said valve shaft and said piston rods carry at their free ends roller bearings which engage said cam areas for retaining said valve or which abut said valve without pressure when said pistons are retracted.

3. A valve operating mechanism according to claim 2, wherein said first cam area is so shaped as to include a ramp area which is engaged by said roller bearing associated with said first hydraulic cylinder and piston structure when said valve is in said closed position, said ramp being so arranged that length variations can be accommodated by a corresponding engagement depth of said roller bearing into said cam area, and wherein said roller bearing associated with said second hydraulic cylinder and piston structure engages said second cam area when said valve is in its open end position and, said piston of said second hydraulic cylinder and piston structure is hydraulically forced to its outer end position against the force of said spring means.

4. A valve operating mechanism according to claim 1, wherein one control valve is provided for controlling the pressurized fluid supply to the cylinder and piston structures of several engine cylinders.

5. A valve operating mechanism according to claim 4, wherein a fluid supply distribution control shaft is provided running at one half of engine crankshaft speed and including means providing for communication with the respective hydraulic cylinder and piston structures for certain angular position ranges of said control shaft.

6. A valve operating mechanism according to claim 4, wherein said spring biasing said valve in opening direction is seated on a spring support washer having connected thereto a control piston which, depending on the lift position of the engine breathing valve, opens or closes a communication line between the respective hydraulic cylinder and piston structure and said control valve.

7. A valve operating mechanism according to claim 4, wherein said first hydraulic cylinder and piston structures are subjected to fluid under pressure always at the same angular crankshaft position so that said breathing valves are opened always at the same angular crankshaft positions.

8. A valve operating mechanism according to claim 1, wherein said compression spring biasing said breathing valve in opening direction is adjustably pre-tensioned.

* * * * *